US009814647B2

(12) United States Patent
Ajiki

(10) Patent No.: US 9,814,647 B2
(45) Date of Patent: Nov. 14, 2017

(54) MASSAGE APPARATUS AND MASSAGE METHOD

(71) Applicant: Panasonic Intellectual Property Management Co., Ltd., Osaka (JP)

(72) Inventor: Kaori Ajiki, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 446 days.

(21) Appl. No.: 14/639,155

(22) Filed: Mar. 5, 2015

(65) Prior Publication Data

US 2015/0257964 A1 Sep. 17, 2015

(30) Foreign Application Priority Data

Mar. 13, 2014 (JP) ..... 2014-049839

(51) Int. Cl.
*A61H 7/00* (2006.01)
*A61H 1/00* (2006.01)
*A61H 23/02* (2006.01)

(52) U.S. Cl.
CPC ..... *A61H 1/008* (2013.01); *A61H 7/001* (2013.01); *A61H 7/007* (2013.01);
(Continued)

(58) Field of Classification Search
CPC .... A61H 1/008; A61H 23/0245; A61H 7/007; A61H 7/001; A61H 2201/02;
(Continued)

(56) References Cited

U.S. PATENT DOCUMENTS 4,574,787 A * 3/1986 Jacobs ..... A61H 39/04 601/148
8,517,963 B2 * 8/2013 Larson ..... A61B 17/1325 600/16

(Continued)

FOREIGN PATENT DOCUMENTS

FR 2971933 8/2012
JP 3-236289 10/1991

(Continued)

OTHER PUBLICATIONS

Extended European Search Report dated Jul. 21, 2015 for European Patent Application No. 15157489.4.

(Continued)

*Primary Examiner* — Steven Douglas
(74) *Attorney, Agent, or Firm* — Greenblum & Bernstein, P.L.C.

(57) ABSTRACT

A massage apparatus includes a sheet member attachable to a skin of a body, and a pressure unit that presses the skin from the sheet member. The sheet member is elastic and thermoplastic such that the sheet member is hardened at a temperature of the skin and is softened at a predetermined temperate different from the temperature of the skin. The sheet member has one or more indications indicating an area of the skin to which the sheet member is to be attached. The pressure unit applies a pressure to the skin so as to provide a predetermined pressure distribution in which positions of the pressure distribution are defined with reference to one or more positions on the body in a situation in which the sheet member is attached to the area.

11 Claims, 10 Drawing Sheets

(52) U.S. Cl.
CPC ..... *A61H 23/0245* (2013.01); *A61H 2201/0192* (2013.01); *A61H 2201/0196* (2013.01); *A61H 2201/0207* (2013.01); *A61H 2201/1207* (2013.01); *A61H 2201/1604* (2013.01); *A61H 2201/165* (2013.01); *A61H 2201/5002* (2013.01); *A61H 2205/022* (2013.01); *A61H 2205/106* (2013.01); *A61H 2205/12* (2013.01); *A61H 2230/08* (2013.01); *A61H 2230/25* (2013.01); *A61H 2230/50* (2013.01)

(58) Field of Classification Search
CPC .... A61H 2201/0207; A61H 2201/1604; A61H 2201/5002; A61H 2201/165; A61H 2201/1207; A61H 2201/0192; A61H 2201/0196; A61H 2201/0214; A61H 2201/1607; A61H 2201/50; A61H 2205/02; A61H 2205/022; A61H 2205/023; A61H 2205/024; A61H 2205/12; A61H 2205/106
See application file for complete search history.

(56) References Cited

U.S. PATENT DOCUMENTS

| | | | | |
|---|---|---|---|---|
| 8,894,593 | B2 * | 11/2014 | Ikeyama | A61H 23/0263 601/46 |
| 9,161,878 | B1 * | 10/2015 | Pamplin | A61H 23/02 |
| 9,384,947 | B2 * | 7/2016 | Watson | A61M 16/12 |
| 2006/0182704 | A1 * | 8/2006 | Gianelli | A45D 44/002 424/70.14 |
| 2007/0257256 | A1 | 11/2007 | Kugler | |
| 2008/0262327 | A1 | 10/2008 | Kato | |
| 2009/0058274 | A1 | 3/2009 | Yokoyama et al. | |
| 2010/0191314 | A1 * | 7/2010 | Young | A61F 7/03 607/109 |
| 2012/0253243 | A1 | 10/2012 | Ikeyama et al. | |
| 2013/0102937 | A1 | 4/2013 | Ehrenreich et al. | |
| 2013/0303957 | A1 * | 11/2013 | Bauerfeind | A61F 5/0111 602/44 |
| 2014/0142477 | A1 * | 5/2014 | Park | A61H 23/02 601/46 |
| 2015/0073316 | A1 * | 3/2015 | Bende | A61H 23/00 601/46 |
| 2015/0257711 | A1 * | 9/2015 | Chen | A61B 5/7282 601/134 |
| 2016/0058657 | A1 * | 3/2016 | Lal | A61H 23/02 601/134 |
| 2016/0120734 | A1 * | 5/2016 | Ishikawa | A61B 5/6805 601/151 |
| 2016/0242987 | A1 * | 8/2016 | Nagata | A61H 3/00 |

FOREIGN PATENT DOCUMENTS

| | | |
|---|---|---|
| JP | 7-051338 | 2/1995 |
| JP | 2001-276113 | 10/2001 |
| JP | 2005-027702 | 2/2005 |
| JP | 2007-300112 | 11/2007 |
| JP | 2009-048837 | 3/2009 |
| JP | 2010-075288 | 4/2010 |
| JP | 2011-099121 | 5/2011 |
| JP | 2013-168575 | 8/2013 |
| KR | 2012076397 | 7/2012 |
| WO | 2006/009178 | 1/2006 |
| WO | 2013/151128 | 10/2013 |

OTHER PUBLICATIONS

Takanori Kiyokura et al. "Wearable Laser Blood Flowmeter" NTT Technical Review, pp. 25-27, Nov. 2005 (Partial Translation).

* cited by examiner

100

| SENSOR COORDINATES = (nd, md) | |
|---|---|
| MEASUREMENT TIME | PRESSURE VALUE |
| 5 | 0.5 |
| 6 | 0.8 |
| 7 | 0.7 |
| 8 | 0.4 |
| 21 | 0.4 |
| 22 | 0.7 |
| 23 | 1.0 |
| 24 | 0.9 |
| 48 | 0.6 |
| 49 | 0.8 |
| 50 | 1.0 |
| 51 | 1.0 |
| ⋮ | ⋮ |

FIG. 9

710

| 711 | 712 | 713 |
|---|---|---|
| PRESSURE ELEMENT | x COORDINATE VALUE IN RELATIVE COORDINATE SYSTEM | y COORDINATE VALUE IN RELATIVE COORDINATE SYSTEM |
| FIRST PRESSURE ELEMENT | x1 | y1 |
| SECOND PRESSURE ELEMENT | x2 | y2 |
| • • • | • • • | • • • |
| L-TH PRESSURE ELEMENT | xL | yL |

MASSAGE APPARATUS AND MASSAGE METHOD

BACKGROUND

1. Technical Field

The present disclosure relates to a massage apparatus and a massage method.

2. Description of the Related Art

A massage apparatus is widely used to press a skin of a body thereby improving blood circulation or the like (see, for example, Japanese Unexamined Patent Application Publication No. 7-51338).

In a technique disclosed in Japanese Unexamined Patent Application Publication No. 7-51338 (hereinafter referred to as the conventional technique), a plurality of pressure elements are disposed on a flexible sheet-shaped member capable of being attached to a body such that the sheet-shaped member is in intimate contact with a skin of the body. In the conventional technique, the pressure elements are operated in the state in which the sheet-shaped member is in direct contact with the skin thereby pressing the skin. Use of the conventional technique allows it to easily perform massage without a hard work.

SUMMARY

Effects of the massage greatly vary depending on a manner of massage. Therefore, there is a need for reproducing an effective manner of massage using the conventional technique. In the effective manner of massage, in some cases, a rather high pressing force is applied to a skin.

Locations of parts of a body (which may be a face, for example) vary among individuals, and thus pressing applied may be at wrong positions different from correct positions even when the massage is performed in the same manner. Besides, when the sheet-shaped member is formed of a flexible material, it is difficult to apply a strong pressing force to a skin. For the above reasons, there is a possibility that use of the conventional technique does not allow the massage to be performed properly.

One non-limiting and exemplary embodiment provides a massage apparatus capable of more properly performing massage.

In one general aspect, the techniques disclosed here feature that a massage apparatus includes a sheet member attachable to a skin of a body, and a pressure unit that applies a pressure to the skin from the sheet member, wherein the sheet member is elastic and thermoplastic such that the sheet member is hardened at a temperature of the skin and is softened at a predetermined temperate different from the temperature of the skin, wherein the sheet member has one or more indications indicating an area of the skin to which the sheet member is to be attached, and wherein the pressure unit applies the pressure to the skin with a predetermined pressure distribution defined with reference to positions of parts of the body (one or more positions on the body) in a state in which the sheet member is attached to the area.

The techniques disclosed here make it possible to perform massage in a more proper manner.

It should be noted that general or specific embodiments may be implemented as a system, a method, an integrated circuit, a computer program, a storage medium, or any selective combination thereof.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

BRIEF DESCRIPTION OF THE DRAWINGS

FIG. 9 is a diagram illustrating an example of a correspondence between pressure elements and their positions according to the second embodiment.

DETAILED DESCRIPTION

Embodiments of the present disclosure are described below in detail with reference to drawings.

First Embodiment

A first embodiment of the present disclosure is an example of a basic aspect of the present disclosure.

Figure 1:
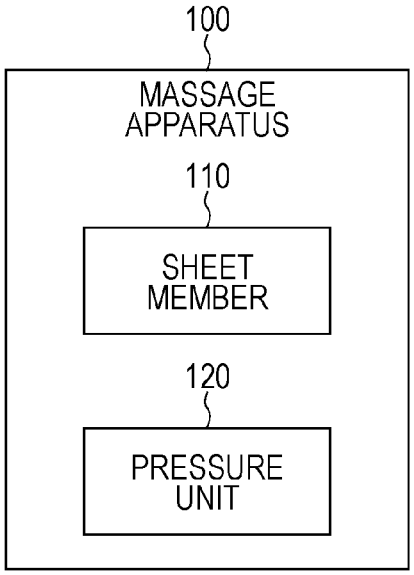
FIG. 1 is a block diagram illustrating an example of a structure of a massage apparatus according to a first embodiment of the present disclosure.

FIG. 1 is a block diagram illustrating an example of a structure of a massage apparatus according to the first embodiment.

In FIG. 1, the massage apparatus 100 includes a sheet member 110 and a pressure unit 120.

The sheet member 110 is a member attachable to a skin of a body. The sheet member 110 is elastic and thermoplastic such that the sheet member 110 is hardened at a temperature of the skin and is softened at a predetermined temperate different from the temperature of the skin. The sheet member 110 has an indication representing a skin area to which the sheet member 110 is to be attached. For example, the skin area corresponds to an area including particular parts of a body (one or more positions of the body).

The pressure unit 120 presses a skin from the sheet member 110. The pressure unit 120 presses the skin so as to provide a particular pressure distribution defined with reference to locations of particular parts of the body (one or more positions on the body) in a state in which the sheet member 110 is attached (in intimate contact) to the area described above.

The massage apparatus 100 includes, for example, a central processing unit (CPU), a storage medium such as a read only memory (ROM) in which a control program is stored, a random access memory (RAM) or the like serving as a work memory, a pressure element (actuator) and the like, although they are not illustrated in the figure. In this configuration, a function of the pressure unit 120 is realized by executing the control program by the CPU.

The massage apparatus 100 allows a user to easily attach the sheet member 110 to a correct area of a skin. The massage apparatus 100 is capable of pressing the skin so as to provide a specified pressure distribution defined with respect to locations of particular parts of a body (one or more positions of the body). Thus, the massage apparatus 100 according to the present embodiment is capable of performing massage more properly than is possible according to the conventional technique.

Second Embodiment

A second embodiment of the present disclosure presents a specific example of an aspect of the present disclosure applied to a face sheet that covers a face. That is, in this example, a face is the area of the body to which the massage is performed.

Appearance and Configuration of Massage Apparatus

First, a description is given as to an external appearance and a structure of the massage apparatus according to the present embodiment.

Appearance of Massage Apparatus

Figure 2:
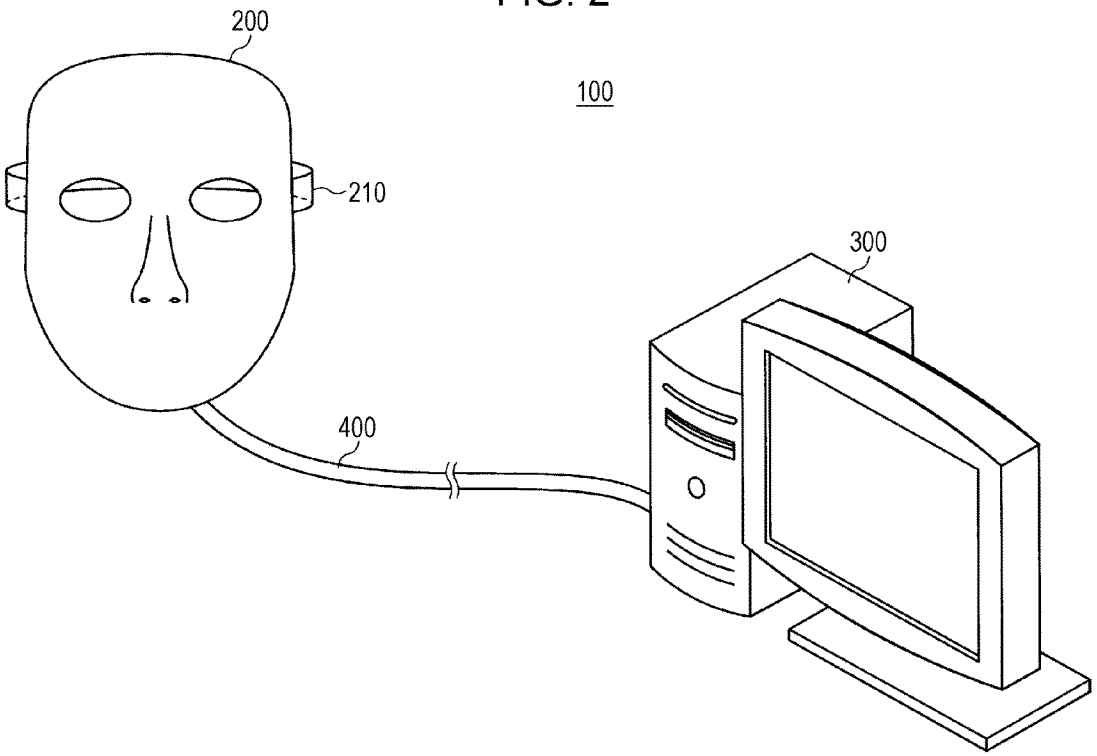
FIG. 2 is a diagram illustrating an example of an appearance of a massage apparatus according to a second embodiment of the present disclosure.

FIG. 2 is a diagram illustrating an example of an external appearance of the massage apparatus according to the present embodiment.

As illustrated in FIG. 2, the massage apparatus 100 includes a sheet device 200 and a control unit 300.

The sheet device 200 is a device formed in the shape of a sheet capable of three-dimensionally covering the surface of a face and having openings formed at least at locations corresponding to eyes and nostrils. That is, the area to which the sheet device 200 is to be attached (hereinafter, such an area will be referred to as a target area) is, in this case, an area of a skin of a face excluding at least eye areas and nostril areas.

The sheet device 200 has elasticity and thermoplasticity. The elasticity and the thermoplasticity of the sheet device 200 allow it to attach the sheet device 200 correctly to the target area such that the sheet device 200 is in intimate contact with a three-dimensional shape of a face by adjusting the position with reference to locations of various parts of a face such as inner eye corners, a point of jaw, or the like (hereinafter such parts of a face will be referred to as face parts). Note that the "intimate contact" does not necessarily need to be "intimate" all over the area, but the contact may partially include a non-intimate contact. It is possible to fix the sheet device 200 by fastening a fixing band 210 to a back of the head thereby making it possible to maintain the state in which the sheet device 200 is attached to the target area. The elasticity and the thermoplasticity of the sheet device 200 will be described in further detail later.

It is desirable to provide a plurality of sheet devices 200 with different sizes so that it is allowed to select a proper one of the sheet devices 200 depending on a size of a face. Note that the sheet device 200 may have a size slightly smaller than the size of the face to which the sheet device 200 is to be attached. That is, the sheet device 200 is produced assuming that it is expanded in a horizontal or vertical direction when it is attached to the face.

On the sheet device 200, a plurality of pressure elements (not illustrated) are disposed on its surface which is brought into contact with the face (hereinafter, such a surface will be referred to as an inner surface). The structure of the pressure elements and the structure of the sheet device 200 including the pressure elements arranged thereon will be described in detail later.

The control unit 300 may be an information processing apparatus such as a personal computer. In the state in which the sheet device 200 is attached to a face and is hardened (hereinafter such a state will be referred to as attached-and-hardened state), the control unit 300 operates the plurality of pressure elements so as to provide massage according to specified massage operation parameters. That is, the control unit 300 controls the pressing of the skin of the face. Note that in the present embodiment, the massage operation parameters are parameters associated with how large pressures are applied to which part of the target area during the massage. The control unit 300 is connected to the sheet device 200 via the cable 400.

The cable 400 includes signal lines that connect the control unit 300 to the respective pressure elements although they are not illustrated in figures.

Structure of Sheet Device

Figure 3:
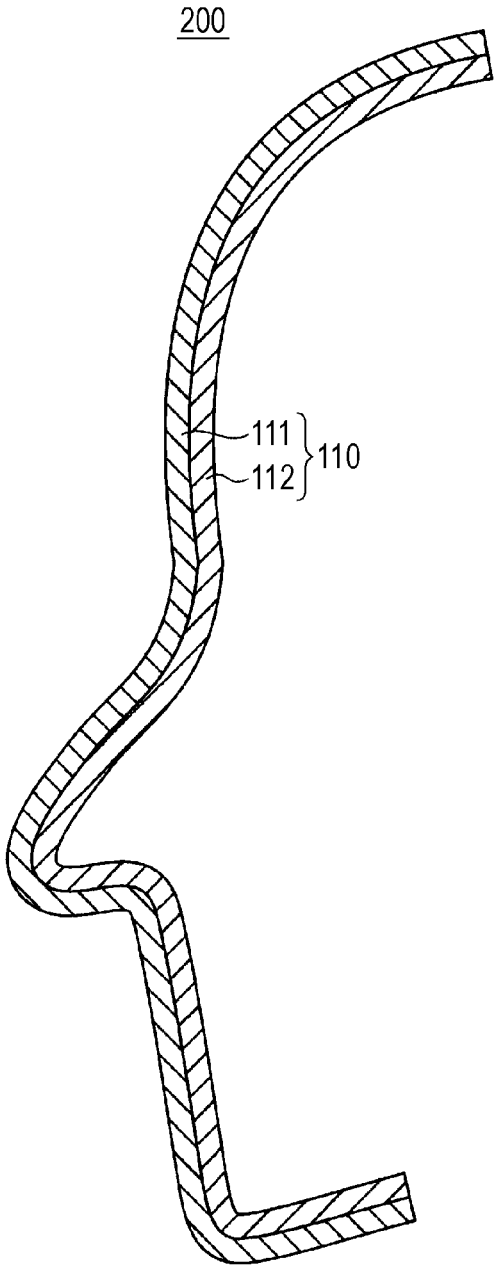
FIG. 3 is a diagram illustrating an example of a structure in cross section of a sheet device according to the second embodiment of the present disclosure.
Figure 4:
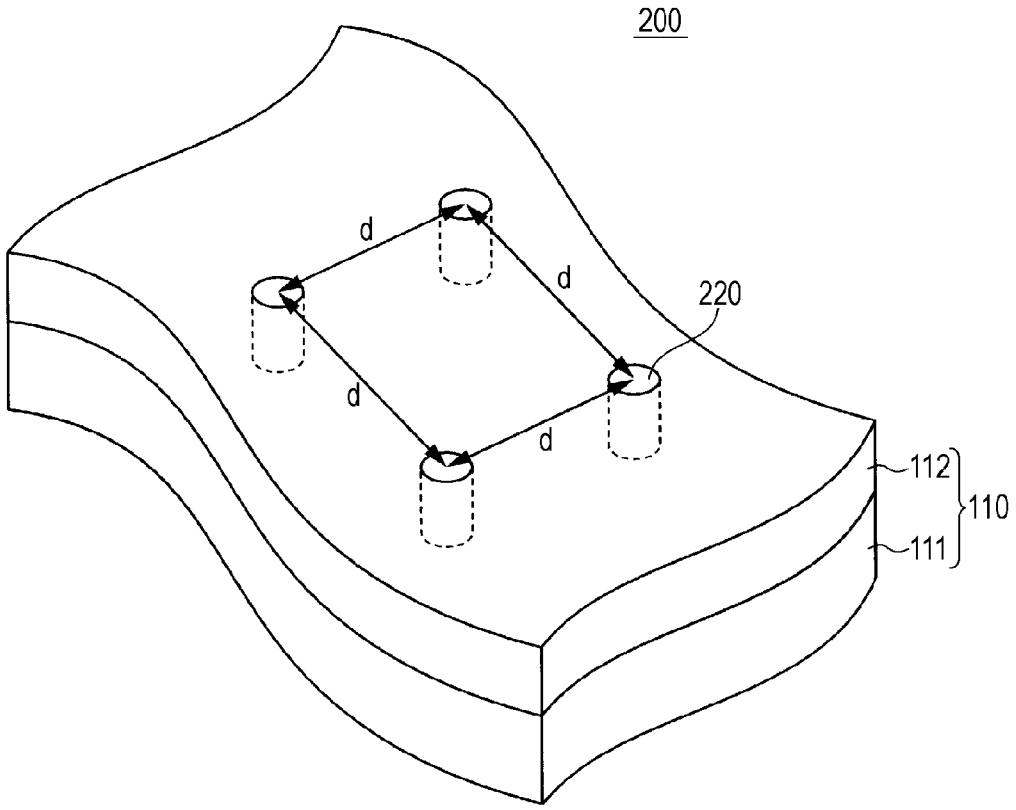
FIG. 4 is a diagram illustrating an example of a structure of a sheet device according to the second embodiment.

FIG. 3 is a diagram illustrating an example of a structure in cross section of the sheet device 200. FIG. 4 is a diagram illustrating an example of a configuration of a sheet device 200. Note that FIG. 4 illustrates a part of the sheet device 200.

As illustrated in FIG. 3 and FIG. 4, the sheet device 200 has a two-layer structure including an outer layer 111 disposed on a side (non-contact side) opposite to a side directly brought in contact with a face and an inner layer 112 disposed on the side directly brought in contact with the face. Hereinafter, the sheet-shaped member including the outer layer 111 and the inner layer 112 will be referred to as the sheet member 110.

The outer layer 111 is formed of a material that is hardened at a skin temperature (for example 37° C. or lower) and that is softened at a predetermined temperature (for example, 42° C. or higher) different from the skin temperature.

As for the material of the outer layer 111, for example, a thermoplastic shape-memory polymer whose plasticization temperature can be set such that it is softened at temperatures lower than 80° C. and hardened at temperatures lower than 40° C., such as that, for example, disclosed in Japanese Unexamined Patent Application Publication No. 2011-99121 may be employed. As for a material for the rigid layer, a shape memory macromolecule such as hexalactone, polyurethane, polyenes, cross-linked polyethylene, or the like may be employed.

The inner layer 112 is formed of an elastic sheet member as a main material. As for the sheet member serving as the main material, for example, an energy ray-curable composition material including a polyurethane polymer terminated with an acryloyl group and an acrylic monomer such as that disclosed in Japanese Unexamined Patent Application Publication No. 2013-168575 may be employed.

The outer layer 111 and the inner layer 112 are elastically bonded together. Thus, the sheet member 110 as a whole has elasticity and thermoplasticity.

Furthermore, as illustrated in FIG. 4, the sheet device 200 also includes pressure elements 220 embedded in the inner layer 112 of the sheet member 110.

In the state (in the intimate contact state) in which the sheet member 110 is attached to a skin, the pressure elements 220 each generate a pressing force against a skin in a direction (in a vertical direction in FIG. 4) normal to the sheet member 110.

The pressure elements 220 are disposed, for example, at intervals of d in a matrix such that one pressure sensor 210 is located in each one of imaginal subareas produced by conceptually dividing a part or all of the target area (the sheet member 110). The length d is, for example, determined based on the distance between a position corresponding to the left inner eye corner and a position corresponding to the right inner eye corner in a state in which the sheet device 200 is not expanded (see FIG. 5).

That is, each subarea has its own pressure element 220 disposed therein thereby making it possible to press a skin in the subarea with a specified pressure value.

As for each pressure element 220, an electrostrictive element capable of generating a high pressure with a low voltage such as that disclosed, for example, in Japanese Unexamined Patent Application Publication No. 3-236289 may be employed. The pressure element 220*s* and control lines (not illustrated), which are embedded in the sheet device 200 for use in controlling the pressure elements 220, have heat resistance and water resistance so as to allow the sheet member 110 to be warmed with hot water to be softened.

The sheet device 200 has markers on the surface of the sheet member 110 opposite to the surface brought into contact with the face (hereinafter, this surface will be referred to as the outer surface) thereby indicating points that are to be positioned with respect to face feature points (target points) such as an inner eye corner (hereinafter such a point will be referred to simply as a face feature point). The points whose position is to be adjusted with respect to the face feature points are points that come to positions close to face feature points when the sheet device 200 is correctly attached to the target area.

Figure 5:
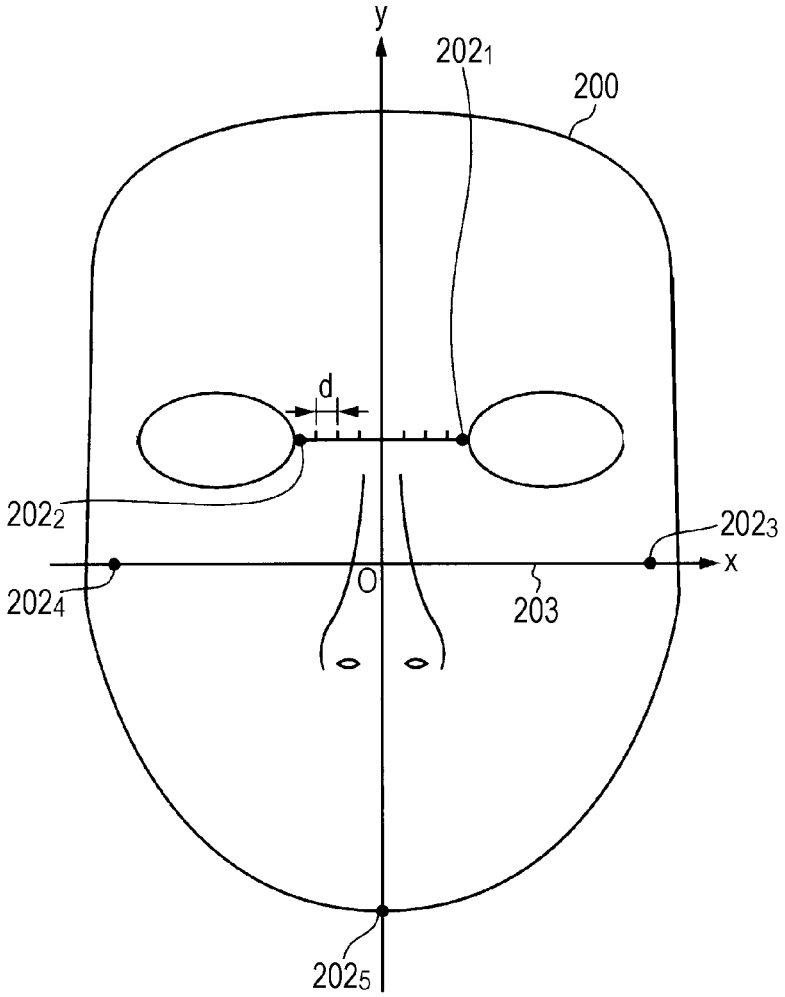
FIG. 5 is a diagram illustrating an example of an arrangement of markers according to the second embodiment.

FIG. 5 is a diagram illustrating an example of an arrangement of markers on the sheet device 200.

As illustrated in FIG. 5, the sheet device 200 has markers $\mathbf{202}_1$, $\mathbf{202}_2$, $\mathbf{202}_5$, $\mathbf{202}_3$, and $\mathbf{202}_4$ (represented by solid dots in FIG. 5) at locations corresponding to face feature points, and more specifically, at locations respectively corresponding to a left inner eye corner, a right inner eye corner, a point of jaw, an apex of the left cheekbone, and an apex of the right cheekbone. That is, the sheet device 200 has markers $\mathbf{202}_1$ to $\mathbf{202}_5$ serving as position adjust markers thereby making it possible to attach the sheet device 200 correctly to the target area. That is, the markers $\mathbf{202}_1$ to $\mathbf{202}_5$ indicate the area of the skin (locations of particular parts of the face) to which the sheet device 200 is to be attached (in an intimate manner).

For example, a user may soften the sheet device 200 by immersing it in hot water with a temperate equal to or higher than 42° C. and then the user may attach the sheet device 200 to her/his face while expanding the sheet device 200 such that the respective markers $\mathbf{202}_1$ to $\mathbf{202}_5$ come to locations close to the corresponding face feature points. This makes it possible for the massage reception person to attach the sheet device 200 correctly to the target area. Furthermore, by putting the fixing band 210 to a back of the head, it is possible to cool the sheet device 200 while maintaining the state in which the sheet device 200 is fixed with the fixing band 210 until the sheet device 200 comes into the attached-and-hardened state described above.

Note that in a case where the sheet device 200 has a shape representing the area of the face to which the sheet device 200 is to be attached to, as in the case of the example illustrated in FIG. 5, the markers are not necessarily needed.

The locations of the respective pressure elements are defined using a relative coordinate system 203 determined based on a plurality of locations $\mathbf{202}_1$ to $\mathbf{202}_5$ (same as the locations of the markers in this embodiment) corresponding to a left inner eye corner, a right inner eye corner, a point of jaw, an apex of the left cheekbone, and an apex of the right cheekbone.

For example, the relative coordinate system 203 is set in a plane including positions $\mathbf{202}_3$ to $\mathbf{202}_5$ respectively corresponding to the point of the jaw, the apex of the left cheekbone, and the apex of the right cheekbone, such that a y axis is passes through the positions $\mathbf{202}_3$ and $\mathbf{202}_4$ and an x axis is perpendicular to the y axis and passes through the position $\mathbf{202}_5$. Coordinate values in the relative coordinate system 203 are represented in units of d equal to one eighth of the distance between the left inner eye corner and the right inner eye corner in the above-described plane, that is, the d is equal to the pitch distance of the arrangement of pressure elements 220.

The relative coordinate system 203 is, as described above, a coordinate system defined based on a location of a part of a face (face parts) (one or more locations on a face) in a state in which the sheet device 200 is attached to the target area.

The relative coordinate system 203 defined in the above-described manner is not influenced by a difference in locations of particular face parts (face feature points) among individuals, and thus use of the relative coordinate system 203 makes it possible to give a spatially normalized expression of the distribution of the pressure applied to the skin during the massage. Thus, it becomes possible to perform massage in a more proper manner based on the massage operation parameters expressed using the relative coordinate system 203 and the locations of the respective pressure elements 220 defined using the relative coordinate system 203.

In the present embodiment, the sheet device 200 includes L pressure elements 220. Note the number and locations of pressure elements 220 are not limited to those in the example illustrated in FIG. 4. The arrangement density of pressure elements 220 in the sheet device 200 may or may not be uniform.

Functional Configuration of Massage Apparatus

Figure 6:
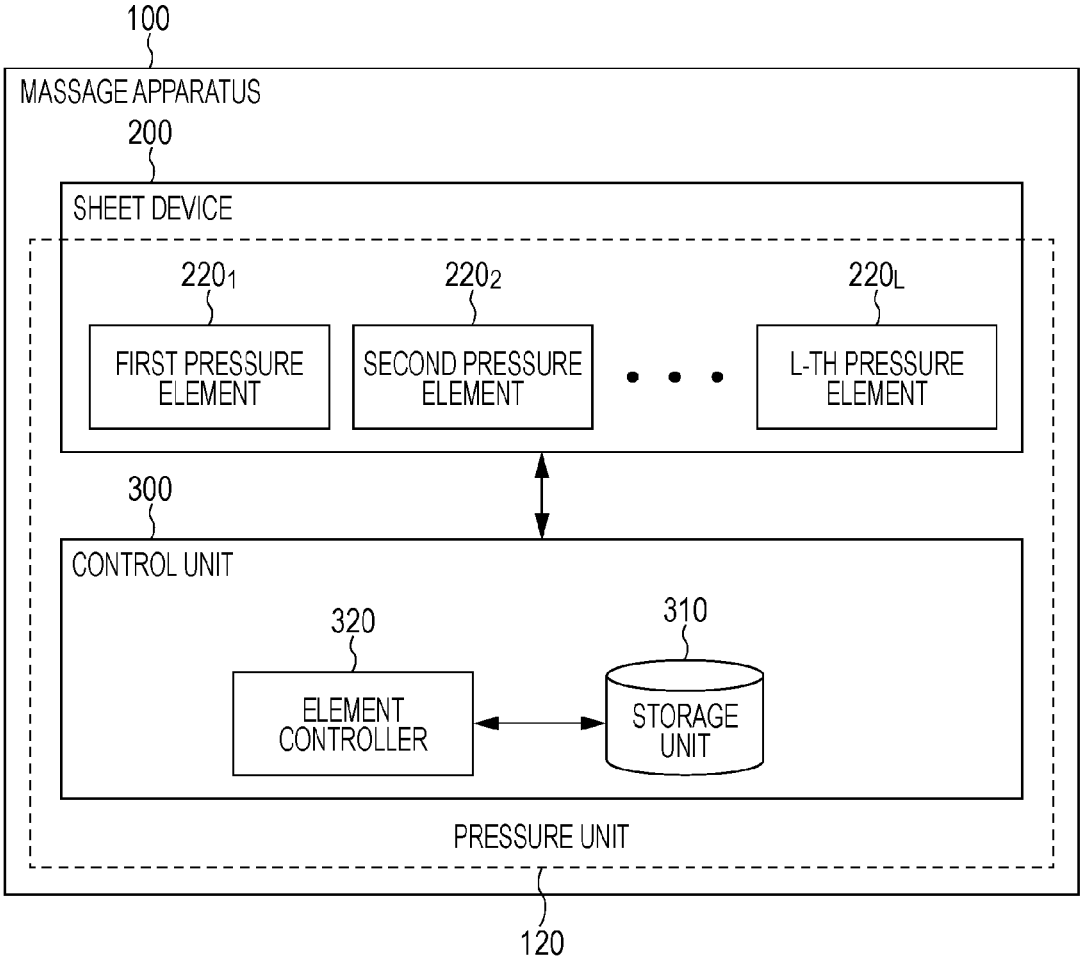
FIG. 6 is a diagram illustrating an example of a functional configuration of a massage apparatus according to the second embodiment.

FIG. 6 is a diagram illustrating an example of a functional configuration of the massage apparatus 100.

In FIG. 6, the massage apparatus 100 includes first to L-th pressure elements $\mathbf{220}_1$ to $\mathbf{210}_L$ disposed on the sheet device 200 (see FIGS. 2 to 5). The massage apparatus 100 further includes a storage unit 310 and an element controller 320, which are disposed in the control unit 300 (see FIG. 2). For example, the combination of the first to L-th pressure elements $\mathbf{220}_1$ to $\mathbf{210}_L$, the storage unit 310, and the element controller 320 corresponds to the pressure unit 120 of the present disclosure.

The storage unit 310 includes, for example, an information storage medium such as a hard disk or the like. In the storage unit 310, pressure distribution information is stored. The storage unit 310 also stores information representing a correspondence relationship between the pressure elements 220 and their locations. The location of each pressure element 220 in the corresponding region is represented by coordinate values (x coordinate value, y coordinate value) in the relative coordinate system 203 (see FIG. 5). The storage unit 310 includes a table representing this correspondence relationship.

Thus the pressure distribution information is information indicating the pressure distribution to be realized in the massage defined by a combination of the coordinate values in the relative coordinate system 203 (see FIG. 3), the values along the time axis, and the pressure values. That is, the pressure distribution information is information indicating the content of the massage to be performed.

Pressure Distribution Information

Figure 7:
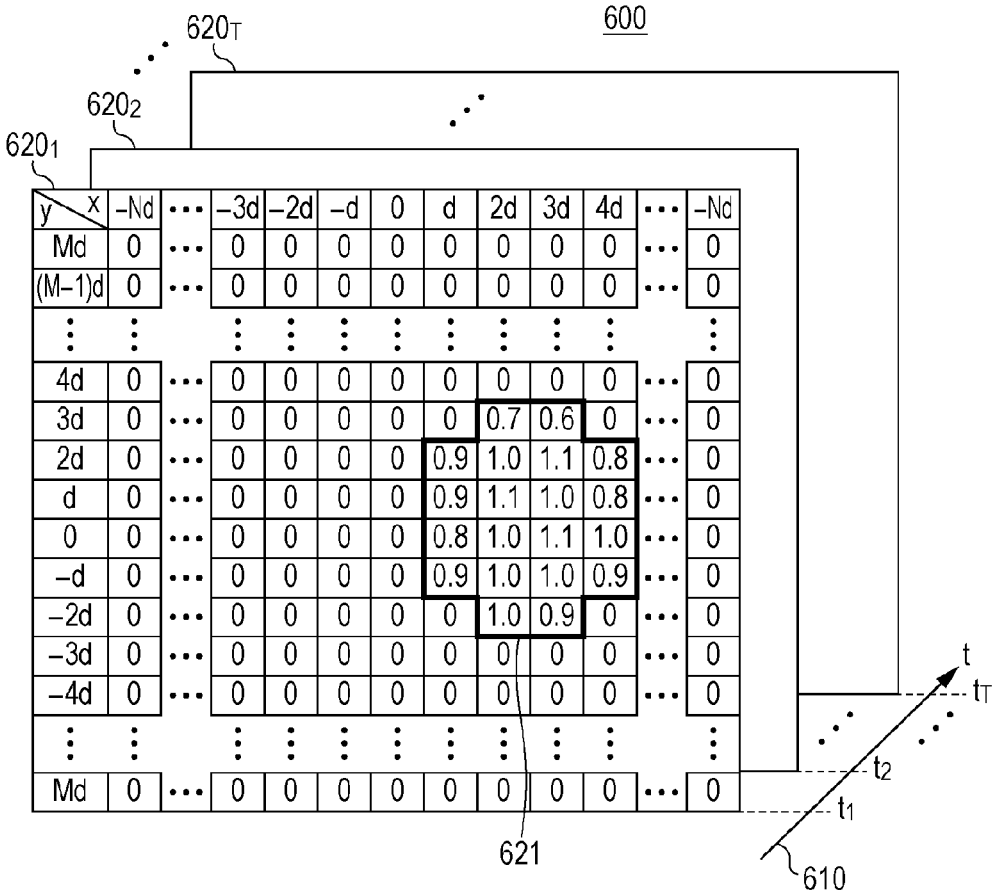
FIG. 7 is a diagram illustrating an example of a set of values representing pressure distribution information according to second embodiment.

FIG. 7 is a diagram illustrating an example of a set of values of the pressure distribution information.

As illustrated in FIG. 7, the pressure distribution information 600 includes information associated with a time axis 610 along which time t corresponding to an elapsed time since a start of massage. The pressure distribution information 600 further includes time-specific pressure value distributions $\mathbf{620}_1$, $\mathbf{620}_2$, . . . , $\mathbf{620}_T$ at respective times $t_1$, $t_2$, . . . , $t_T$ along the time axis 610. Times $t_1$, $t_2$, . . . , $t_T$ are times taken at predetermined time interval dt (for example, at intervals of 0.02 seconds).

Each time-specific pressure value distribution 620 represents pressing forces to be applied to respective subareas of the target area at corresponding time t wherein the pressure values at respective coordinate values in the relative coordinate system 203 are stored in the (2N+1)×(2M+1) matrix. For example, in the time-specific pressure value distribution $\mathbf{620}_1$, a subarea 621 has a pressure value higher than 0, which indicates that pressing is to be performed in this subarea.

Note that the data format of the pressure distribution information 600 is not limited to that illustrated in FIG. 7.

Figure 8:
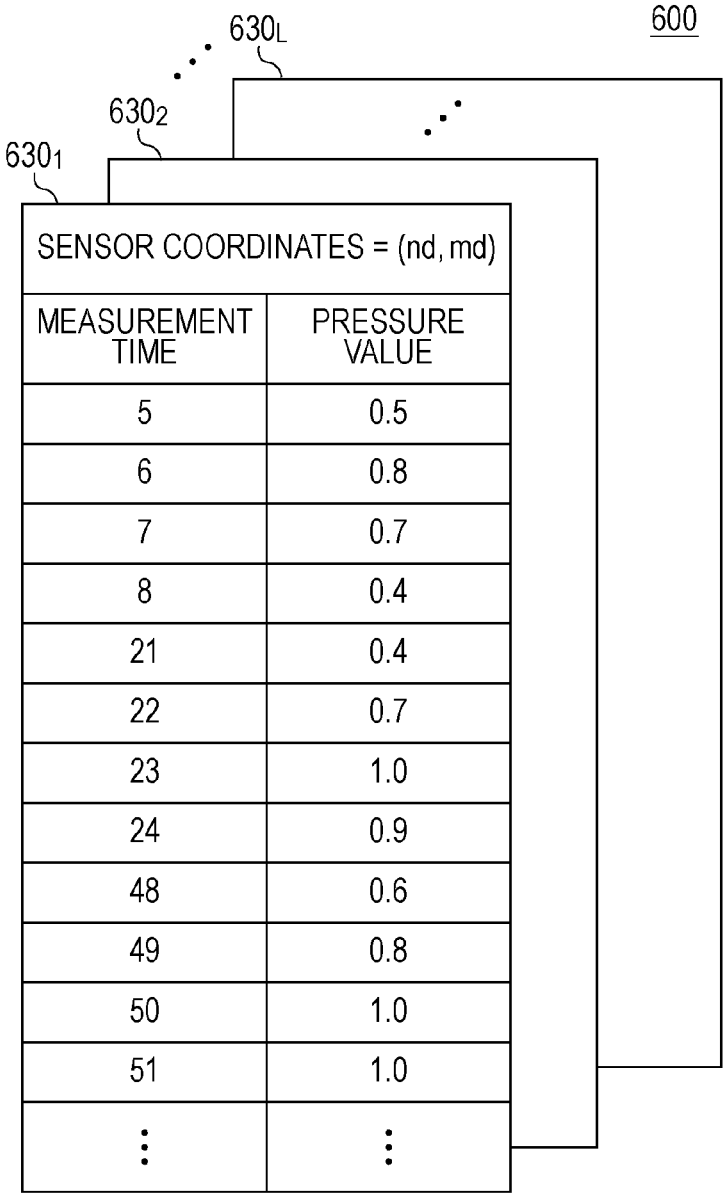
FIG. 8 is a diagram illustrating another example of a set of values representing pressure distribution information according to second embodiment.

FIG. 8 is a diagram illustrating another example of a set of values of the pressure distribution information 600.

As illustrated in FIG. 8, the pressure distribution information 600 may be described in a set of tables $\mathbf{630}_1$, $\mathbf{630}_2$, . . . , $\mathbf{630}_L$ such that each table information associated with a particular position of the target area described in coordinate values in the relative coordinate system 203 and such that each table describes a set of pairs each including a pressure value and time.

In the case where the data format illustrated in FIG. 8 is employed, a pressure value that does not need to be described, such as a pressure value that can be regarded as zero, may not be described. Therefore, usage of the data format illustrated in FIG. 8 allows a reduction in necessary memory capacity compared with the matrix data format illustrated in FIG. 7. On the other hand, when the matrix data format illustrated in FIG. 7 is employed, a frame memory may be provided in the storage unit 310 and the pressure distribution information 600 may be stored in this frame memory thereby making it possible to easily manage each pressure value.

Correspondence Relationship Between Pressure Element and its Location

FIG. 9 is a diagram illustrating an example of a correspondence relationship between the pressure elements and their locations.

As illustrated in FIG. 9, a correspondence relationship 710 represents the location of each pressure element 220. In this table, each pressure element 220 is identified by identification information 711 and the location is expressed by an x coordinate value 712 and a y coordinate value 713 in the relative coordinate system 203. The coordinate values in the relative coordinate system 203 are represented, for example, in units of d equal to the pitch of the arrangement of the pressure elements 220.

By referring to the correspondence relationship 710 described above, it is possible to properly drive the respective pressure elements 220 according to the massage operation parameter expressed using the relative coordinate system 203.

The pressure distribution information 600 and the correspondence relationship 710 may be integrated into a single table. That is, in a case where the location described in the relative coordinate system 203 is known for each pressure element 220, the pressure distribution information 600 may be described such that a pressure value to be applied to a particular subarea is defined for each pressure element 220 and for each time t. In this case, the locations of elements of the (2N+1)×(2M+1) matrix illustrated in FIG. 7 may correspond, for example, to the actual locations of the first to L-th pressure elements $\mathbf{220}_1$ to $\mathbf{220}_L$. In a case where the relationship between an applied voltage value and a pressing force generated by the applied voltage value is known for each pressure element 220. The pressure distribution information 600 defining voltage values to be applied to pressure elements 220 may be described individually for each pressure element 220 and for each time t.

The element controller 320 illustrated in FIG. 6 is connected to the first to L-th pressure elements $\mathbf{220}_1$ to $\mathbf{210}_L$ via the cable 400 (see FIG. 2) that connects the control unit 300 to the sheet device 200 and via high-elasticity control lines (not illustrated) embedded in the sheet device 200 such that the element controller 320 can output a control signal to each pressure element 220 to control the operation of the pressure element 220.

The element controller 320 operates the respective pressure elements 220 according to the pressure distribution information 600 (see FIG. 7 and FIG. 8) and referring to correspondence relationship 710 (see FIG. 9). More specifically, the element controller 320 determines a voltage value to be applied to each pressure element 220 and at each time t such that a pressure with a value specified in the pressure distribution information 600 is applied to a corresponding subarea.

For example, the element controller 320 multiplies the area size of the subarea corresponding to a pressure element 220 of interest and the pressure value for this subarea specified in the pressure distribution information 600, and then the element controller 320 determines the voltage value to be applied by referring to the relationship between the force output by the pressure element 220 and the voltage value applied thereto. The element controller 320 applies voltages with the determined voltage values to the corresponding pressure elements 220 thereby controlling the pressing forces generated by the respective pressure elements 220.

As described above, the sheet device 200 is attached to a face such that various parts thereof are expanded from each other. Therefore, a slight change occurs in the area size of each subarea compared with the area size in a state in which the sheet device 200 is not expanded. In view of the above, the element controller 320 may calculate a correction coefficient associated with the area size of each subarea from the polarity of the electromotive force of the pressure element 220 (electrostrictive element) and a measured value and may correct the force to be output from the pressure element 220. However, the pressure element 220 is not necessarily suitable for the above-described purpose, because the pressure element 220 is designed to generate electromotive force in a direction normal to the sheet member 110. To handle the above situation, the sheet device 200 may include an additional electrostrictive element sensitive to a deformation in a horizontal direction (in a direction in which expansion/contraction occurs) of the sheet device 200 in addition to the pressure elements 220.

The control unit 300 includes a CPU, a storage medium such as a ROM in which a control program is stored, and a work memory such as a RAM, although they are not illustrated in the figure. In this configuration, the function of each part of the control unit 300 is realized by executing the control program by the CPU.

The control unit 300 further includes, although not illustrated, a power supply unit and an operation unit such as a key switch. The power supply unit supplies electric power for operating the CPU and the sheet device 200. The operation unit receives, for example, various operations performed by a user. An example of an operation is that for starting massage.

By configuring the massage apparatus 100 in the above-described manner, it becomes possible for a user to easily attach the sheet member 110 correctly to a skin area to which the sheet member 110 is to be attached, and the massage apparatus 100 is capable of pressing a skin so as to provide a specified pressure distribution with respect to positions of particular parts of a face (one or more positions on the face).

Operation of Massage Apparatus

Next, an operation of the massage apparatus 100 is described below.

Figure 10:
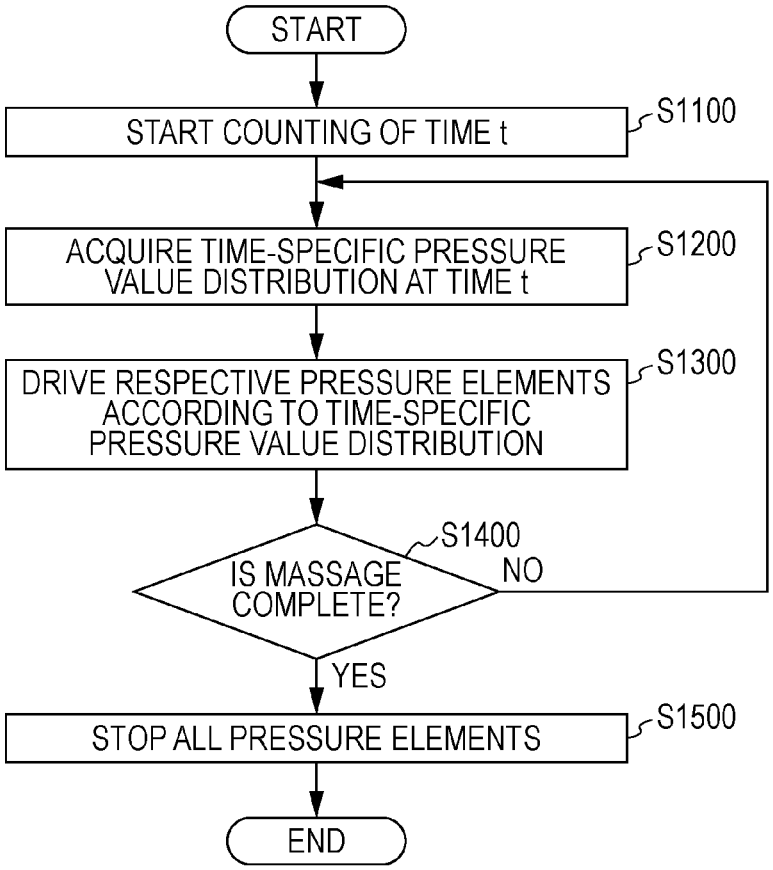
FIG. 10 is a flow chart illustrating an example of an operation of a massage apparatus according to the second embodiment.

FIG. 10 is a flow chart illustrating an example of an operation of the massage apparatus 100.

For example, the sheet device 200 of the massage apparatus 100 is first heated by a user with hot water or the like to a temperature (for example, a bout 42° C.) at which the sheet member 110 is sufficiently softened. The softened sheet device 200 is attached and fixed (fitted) to a face of the user correctly in the target area. After the sheet device 200 is sufficiently hardened, if a user performs an operation to command the massage apparatus 100 to start the operation, the massage apparatus 100 performs the operation as described below.

First, in step S1100, the element controller 320 starts a timer (not illustrated) possessed by the control unit 300 to count time t elapsed from the start of the massage.

Thereafter, in step S1200, the element controller 320 acquires a time-specific pressure value distribution 620 associated with time t (see FIG. 7) from the pressure distribution information 600 stored in the storage unit 310.

Next, in step S1300, the element controller 320 drives the respective pressure elements 220 according to the acquired time-specific pressure value distribution 620. That is, the element controller 320 outputs control signals thereby controlling the respective pressure elements 220 to generate pressing forces with pressure values specified in the time-specific pressure value distribution 620 and controlling the respective pressure elements 220 to maintain the pressing forces.

Next, in step S1400, the element controller 320 determines whether it is to end the massage. The massage is ended, for example, when the massage operation parameter specified in the pressure distribution information 600 are all complete or when a command to end the massage is issued by a user. In a case where the determination is that it is not to end the massage (No in S1400), the element controller 320 returns the processing flow to step S1200.

That is, the element controller 320 performs the process from step S1200 to step S1400 repeatedly until it is determined to end the massage. By performing the process in the above-described manner, the massage apparatus 100 realizes the massage operation according to the massage operation parameters specified in the pressure distribution information 600 as the time elapses from the start of the massage. In the process described above, it is desirable that the element controller 320 performs steps S1200 to S1400 repeatedly at time intervals dt on the time-specific pressure value distribution 620.

When it is determined to end the massage (Yes in S1400), the element controller 320 advances the processing flow to step S1500.

In step S1500, the element controller 320 stops the operation of all pressure elements 220 and ends the sequence of operation steps.

Via the process described above, the massage apparatus 100 realizes the massage operation parameter specified in the pressure distribution information 600 (see FIG. 7 and FIG. 8) in the state in which the sheet device 200 is attached to the target area. In a case where the pressure distribution information 600 employed is that based on information obtained from actually performed massage, the massage apparatus 100 is capable of reproducing the actually performed massage operation parameters with high accuracy.

Effects of Embodiments

According to the embodiments, as described above, the massage apparatus 100 includes the sheet member 110 that is elastic and thermoplastic such that the sheet member 110 is hardened at a temperature of the skin and is softened at a predetermined temperature different from the temperature of the skin and that has the indication representing the area of the skin to which the sheet member 110 is to be attached. In the embodiments, the massage apparatus 100 uses the hardened sheet member 110 as a holder and presses the skin from the sheet member 110 so as to provide the specified pressure distribution with reference to particular positions of the parts of the face (one or more positions on the face) in the state in which the sheet member 110 is attached to the target area.

Thus in the embodiments, the massage apparatus 100 allows a user to easily attach the sheet member 110 to the skin area to which the sheet member 110 is to be attached. Furthermore, in the embodiments, the massage apparatus 100 is capable of pressing the skin so as to provide the specified pressure distribution with respect to particular positions of parts of the face (one or more positions on the face).

Thus in the embodiments, the massage apparatus 100 is capable of performing massage more properly without being influenced by a difference in location of parts of a face (face feature points) among individuals than is possible according to the conventional technique.

Modifications of the Embodiments

The relative coordinate system used to represent the massage operation parameter and to define the locations of the respective pressure elements 220 is not limited to the example described above. For example, the relative coordinate system may be defined based on positions of other face parts (one or more positions of the face) such as ends of eyebrows, eye tails, or the like. For example, in a case where the target area of massage is limited to a particular area (for example, the target area of massage is not the whole face area but a limited area close to an eye), the relative coordinate system may be determined based on one position (for example, a position in the middle of a left inner eye corner and a right inner eye corner). In this case, only one marker may be provided on the sheet device (for example, a marker may be formed on the sheet device at the middle point between two eyes).

Furthermore, the area (target area) to which the sheet member 110 of the sheet device 220 is attached is not limited to an area of a skin of a face. For example, the target area may be a whole back, a calf, a feet bottom, or other areas of a skin of a body. For example, the target area may be an area including three ore more feature points of a body, which are common among many general people.

Even when massage is performed in an exactly same manner, the massage may be excessive depending on a massage reception person. In view of the above, the massage apparatus 100 may monitor the temperature of the skin, the blood flow rate, or the like. If the massage apparatus 100 detects an increase in one of the values to a level beyond a predetermined threshold or detects an increase rate thereof greater than a predetermined threshold value, then the massage apparatus 100 may stop the massage.

For the above purpose, the sheet device 200 may include a sensor disposed on the inner surface to measure a temperature, a blood flow rate, an oxygen saturation, a heart rate, a pulse wave, a blood pressure, a brain wave, and/or the like. Alternatively, data described above may be acquired in cooperation with other measurement apparatuses. As for the temperature sensor disposed on the sheet device 200, for example, a temperature sensor disclosed in International Publication No. 2013/151128 may be employed.

As for the blood flowmeter disposed on the sheet device 200, for example, a blood flowmeter disclosed in Kiyokura Takanori, Shinnji Mino, and Junichi Shimada, "Ultrasmall-size Wearable Laser Blood Flowmeter", NTT Technical Review, pp. 25-27, November, 2005 may be employed. The blood flowmeter may be realized using a laser diode and a phototransistor. As for the laser diode, for example, an organic laser diode produced by a printing technique using a high-molecule polymer such as that disclosed in Japanese Unexamined Patent Application Publication No. 2009-48837 may be used. As for the phototransistor, for example, an organic phototransistor realized by a high-molecule thin-film transistor such as that disclosed in Japanese Unexamined Patent Application Publication No. 2007-300112 may be used. As for the oxygen saturation sensor, for example, an oxygen saturation sensor (biological probe) disclosed in International Publication No. 2006/009178 may be employed. In this case, a skin condition sensor may acquire optical information indicating, not directly but indirectly, the oxygen saturation of blood and may output the acquired optical information to the control unit. The absorption of near-infrared light by a skin is calculated from the optical information and the oxygen saturation of blood flowing through blood capillaries of the skin is calculated from the absorption. The light absorption characteristic of hemoglobin included in blood varies depending on whether the hemoglobin is combined with oxygen or not, as described, for example, in International Publication No. 2006/009178. The near infrared ray is not blocked by the skin, and thus it is possible to measure the oxygen saturation of blood existing below the skin by measuring the absorption of near-infrared light that occurs when the surface of the skin is illuminated with the near-infrared light.

The pressure distribution information used by the massage apparatus 100 may be information indicating the content of the actually performed massage or information created by a computer or the like.

The massage apparatus 100 may include a heating unit that heats the whole sheet member 110 to soften the sheet member 110. As for the heating unit for this purpose, for example, a heating wire in the shape of a mesh may be disposed on the outer layer 111 of the sheet member 110. Alternatively, in a case where the massage apparatus 100 includes a storage box for storing the sheet device 200 or the like, a heating unit or a hot-air heating unit may be disposed in the storage box.

The massage apparatus 100 may receive a selection from a user as to massage to be performed. In this case, for example, the massage apparatus 100 may store in advance pressure distribution information 600 associated with a plurality of massages, and the massage apparatus 100 may present (display) the identification information (massage identification information) of the plurality of massage such that a user is allowed to select one of the plurality of massage. The massage apparatus 100 may operate the pressure elements 220 according to pressure distribution information 600 of one or more massages corresponding to selected identification information.

The massage identification information includes, for example, a name of a target area and a name of the massage. In a case where the pressure distribution information 600 employed is that based on information obtained from actually performed massage, the massage identification information may include a name of a massage operator, a date/time when the massage was performed, and/or the like. The massage identification information may further include information associated with a person to be subjected to the massage such as a type of the massage reception person (a body type, an age, a gender, a skin condition, and the like), a body condition of the massage reception person (the degree of shoulder stiffness, the degree of eyestrain, etc.) and/or the like.

The massage apparatus 100 may acquire the pressure distribution information 600 from another apparatus via communication, for example, by downloading it from a server on the Internet. This makes it possible for the massage apparatus 100 to perform massage in a wide variety manners such as a up-to-date massage manner, a manner simulating a manner of massage employed by authority, or the like. In this case, the massage apparatus 100 may operate the pressure elements 220 while receiving streaming of pressure distribution values associated with each time t.

The massage apparatus 100 may display the massage operation parameter being performed on a display screen (not illustrated) or the outer surface of the sheet device 200. For example, the massage apparatus 100 may generate an image including a face image of a face of a user or a model image, superimpose thereon a color or a marker or the like indicating a place and a pressure strength applied thereto, and display the resultant image. Alternatively, the massage apparatus 110 may include many light emitting diodes (LEDs) disposed on the outer surface of the sheet device 200 and may drive them such that LEDs at locations where pressure is applied emit light with brightness corresponding to the strength of pressure. This makes it possible for the massage apparatus 100 to assist a user to learn the manner of massage.

Part or all of functions of the control unit 300 of the massage apparatus 100 may be provided in an apparatus having other functions such as a portable telephone apparatus or the like.

The functions described above may be provided in a server on a network. That is, one or more functions of the massage apparatus 100 may be realized by a cloud server. In this case, the massage apparatus 100 includes a communication unit for transmitting/receiving information to/from the cloud server that provides the above-described functions.

According to an aspect of the present disclosure, a massage apparatus includes a sheet member attachable to a skin of a body, a pressure unit that applies a pressure to the skin from the sheet member, wherein the sheet member is elastic and thermoplastic such that the sheet member is hardened at a temperature of the skin and is softened at a predetermined temperate different from the temperature of the skin, wherein the sheet member has one or more indications indicating an area of the skin to which the sheet member is to be attached, and wherein the pressure unit applies the pressure to the skin with a predetermined pressure distribution defined with reference to positions of parts of a body (one or more positions on the body) in a state in which the sheet member is attached to the area.

In the massage apparatus described above, the sheet member may have, as the indication, a shape representing the area.

In the massage apparatus described above, the sheet member may have, as the indication, a marker indicating a position to be adjusted with respect to a feature point of the body.

In the massage apparatus described above, the area to which the sheet member is to be attached may be an area of a skin of a face excluding at least eyes and nostrils.

In the massage apparatus described above, the pressure unit may apply the pressure to the skin according to pressure distribution information defining the predetermined pressure distribution by a combination of coordinate values in a relative coordinate system, time, and a pressure value, the relative coordinate system being defined with reference to positions of parts of a body (one or more positions on the body) in a state in which the sheet member is attached to the area.

In the massage apparatus described above, the pressure unit may apply the pressure to the skin with the predetermined pressure distribution using a relative coordinate system defined with reference to one or more positions on the face in a state in which the sheet member is attached to the area, and the relative coordinate system may be defined with reference to at least a plurality of positions on the face, the plurality of positions respectively corresponding to a left inner eye corner, a right inner eye corner, a point of jaw, an apex of the left cheekbone, and an apex of the right cheekbone.

In the massage apparatus described above, the pressure unit may include a plurality of pressure elements that are disposed on the sheet member and that generate pressure to the skin in a state in which the sheet member is attached to the area, and an element controller that controls the plurality of pressure elements according to the predetermined pressure distribution.

In the massage apparatus described above, the pressure element may be an electrostrictive element.

In the massage apparatus described above, the pressure elements may be disposed in respective subareas, into which a part or all of the sheet member is divided, and the predetermined pressure distribution information may be defined by the pressures, which are applied by the respective pressure elements, at positions of the respective pressure elements.

According to an aspect of the present disclosure, a method of massaging, using a sheet member that is capable of being attached to a skin of a body and that has an indication indicating an area of the skin to which the sheet member is to be attached, includes attaching the sheet member to the area of the skin according to the indication, and pressing the skin with a predetermined pressure distribution defined with reference to one or more positions on the body in a state in which the sheet member is attached to the area. The massage method may further include acquiring pressure distribution information defining the predetermined pressure distribution by a combination of coordinate values in a relative coordinate system, time, and a pressure value, the relative coordinate system being defined with reference to positions of parts of a body (one or more positions on the body) in a state in which the sheet member is attached to the area, and the pressing is performed according to the acquired pressure distribution information.

The techniques disclosed herein are useful for realizing a massage apparatus and a massage method capable of providing massage in a more proper manner.

What is claimed is:

1. A massage apparatus comprising:

a sheet member configured to be attachable to a skin of a body; and a pressure actuator configured to apply a pressure to the skin from the sheet member, wherein the sheet member is elastic and thermoplastic such that the sheet member is hardened at a temperature of the skin and is softened at a predetermined temperate different from the temperature of the skin, wherein the sheet member has one or more indications that indicate an area of the skin to which the sheet member is configured to be attached, and wherein the pressure actuator is further configured to apply the pressure to the area of the skin with a predetermined pressure distribution defined with reference to one or more positions on the body.

2. The massage apparatus according to claim 1, wherein the sheet member has, as the indication, a shape representing the area.

3. The massage apparatus according to claim 1, wherein the sheet member has, as the indication, a marker indicating a position to be adjusted with respect to a feature point of the body.

4. The massage apparatus according to claim 1, wherein the pressure actuator is further configured to apply the pressure to the skin according to pressure distribution information defining the predetermined pressure distribution by a combination of coordinate values in a relative coordinate system, time, and a pressure value, the relative coordinate system being defined with reference to one or more positions on the body.

5. The massage apparatus according to claim 1, wherein the area to which the sheet member is configured to be attached is an area of a skin of a face excluding at least eyes and nostrils.

6. The massage apparatus according to claim 5, wherein the pressure actuator is further configured to apply the pressure to the skin with the predetermined pressure distribution using a relative coordinate system defined with reference to one or more positions on the face, and wherein the relative coordinate system is defined with reference to at least a plurality of positions on the face, the plurality of positions respectively corresponding to a left inner eye corner, a right inner eye corner, a point of jaw, an apex of the left cheekbone, and an apex of the right cheekbone.

7. The massage apparatus according to claim 1, wherein the pressure actuator includes a plurality of pressure elements that are disposed on the sheet member and configured to generate pressures to the skin, and an element controller configured to control the plurality of pressure elements according to the predetermined pressure distribution.

8. The massage apparatus according to claim 7, wherein the pressure element is an electrostrictive element.

9. The massage apparatus according to claim 7, wherein the pressure elements are disposed in respective subareas, into which a part or all of the sheet member is divided, and the predetermined pressure distribution is defined by the pressures, which are applied by the respective pressure elements at positions of the respective pressure elements.

10. A method of massaging using a sheet member that is capable of being attached to a skin of a body, that has an indication indicating an area of the skin to which the sheet member is to be attached, and that is elastic and thermoplastic such that the sheet member is hardened at a temperature of the skin and is softened at a predetermined temperate different from the temperature of the skin, the method comprising:

softening the sheet member at the predetermined temperate;

attaching the softened sheet member to the area of the skin according to the indication; and pressing, after the softened sheet member is hardened at the temperature of the skin, the skin with a predetermined pressure distribution defined with reference to one or more positions on the body in a state in which the sheet member is attached to the area.

11. The massage method according to claim 10, further comprising:

acquiring pressure distribution information defining the predetermined pressure distribution by a combination of coordinate values in a relative coordinate system, time, and a pressure value, the relative coordinate system being defined with reference to one or more positions on the body in a state in which the sheet member is attached to the area, wherein the pressing is performed according to the acquired pressure distribution information.

* * * * *